US005087077A

United States Patent [19]

Vercillo

[11] Patent Number: 5,087,077

[45] Date of Patent: Feb. 11, 1992

[54] STAPLE BASED BINDING SYSTEM

[75] Inventor: Alfredo J. Vercillo, Harwood Heights, Ill.

[73] Assignee: General Binding Corporation, Northbrook, Ill.

[21] Appl. No.: 656,227

[22] Filed: Feb. 15, 1991

[51] Int. Cl.[5] ..... B42B 4/00

[52] U.S. Cl. ..... 281/28; 227/28; 227/155; 227/156; 281/27.3; 281/51; 412/6; 412/43

[58] Field of Search ..... 227/28, 155, 156; 281/27.3, 28, 51; 412/6, 42, 43

[56] References Cited

U.S. PATENT DOCUMENTS

| | | | |
|---|---|---|---|
| 1,652,724 | 12/1927 | McBee | 412/43 X |
| 2,057,782 | 10/1936 | La Place | 227/155 X |
| 2,381,985 | 8/1945 | Robinson | 227/155 X |
| 3,871,227 | 3/1975 | Tidwell, Jr. | 227/155 X |
| 4,007,950 | 2/1977 | Giulie | 281/27.3 |
| 4,119,332 | 10/1978 | Merrill | 281/27.3 |
| 4,181,327 | 1/1980 | Merrill | 281/27.3 |
| 4,674,906 | 6/1987 | Abildgaard | 412/43 X |

FOREIGN PATENT DOCUMENTS

| | | | |
|---|---|---|---|
| 825576 | 12/1959 | United Kingdom | 227/155 |
| 1466363 | 3/1977 | United Kingdom | 227/156 |

OTHER PUBLICATIONS

*Xerox Disclosure Journal*, vol. 2, No. 4 Jul. Aug. 1977 pp. 39–40; Perun, William D; "Sheet Binding Assembly".

*Primary Examiner*—Paul A. Bell

*Attorney, Agent, or Firm*—Hill, Van Santen, Steadman & Simpson

[57] ABSTRACT

The system disclosed herein includes a pair of polymeric elongated edge-binding strips, each of which includes upstanding staple-like members extending from the strip adjacent the center and the ends thereof. Staple deforming depressions are positioned adjacent each staple-like member. In use a pair of edge-binding strips are positioned opposite each other and are used to bind a series of stacked sheets. In such a case, the strips are arranged to face other with staples from one strip aligned with depressions and another strip and vice versa.

10 Claims, 3 Drawing Sheets

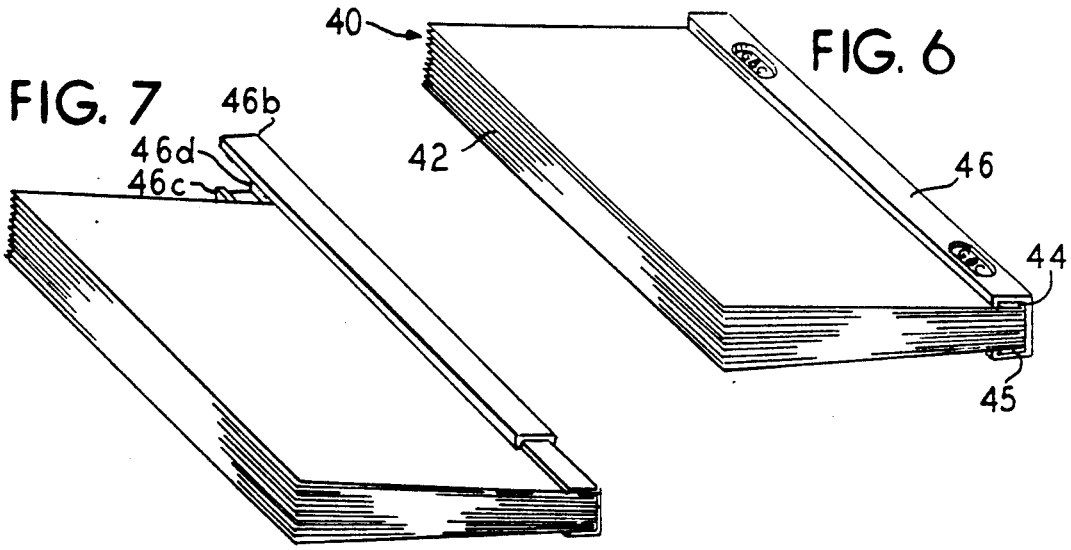
FIG. 6
FIG. 7
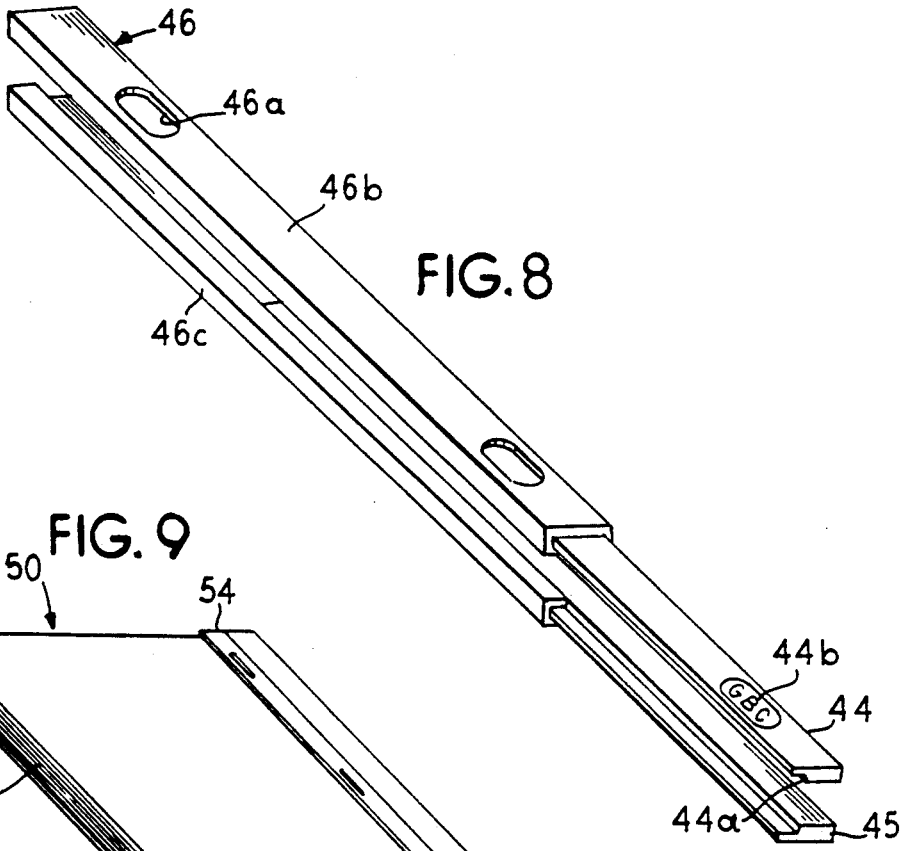
FIG. 8
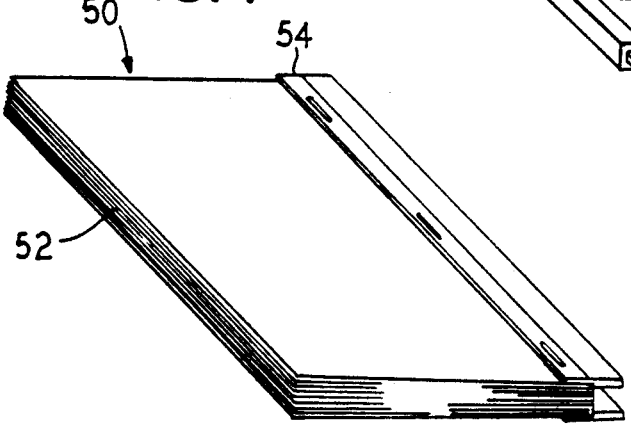
FIG. 9

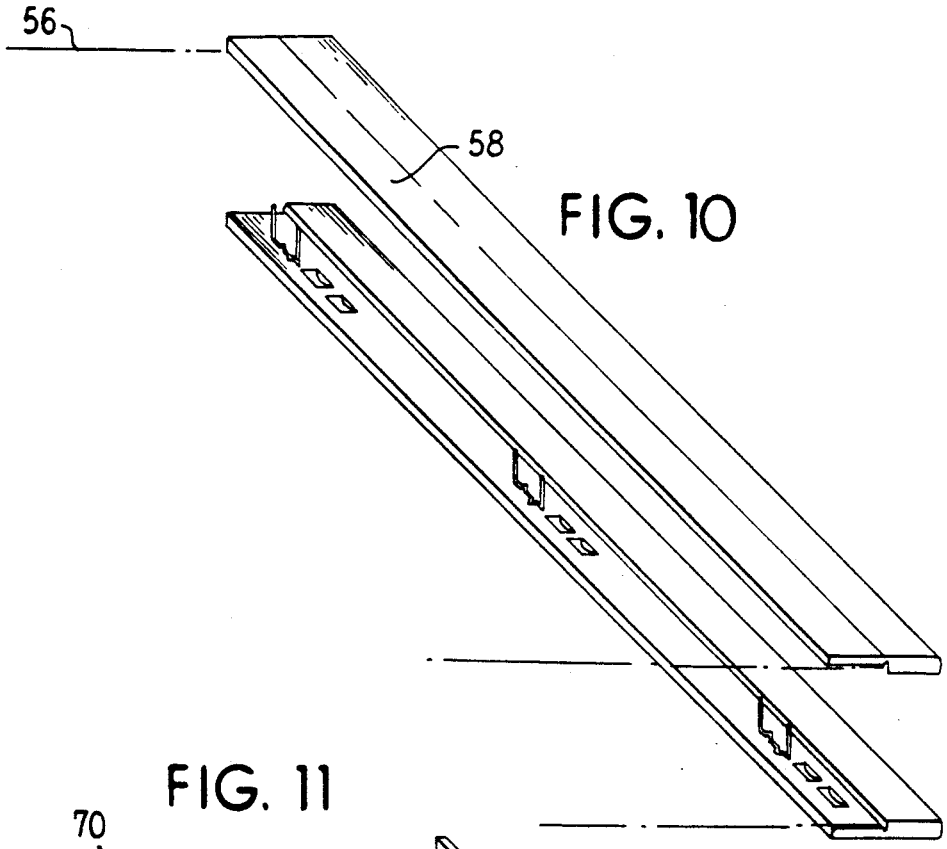
FIG. 10
FIG. 11
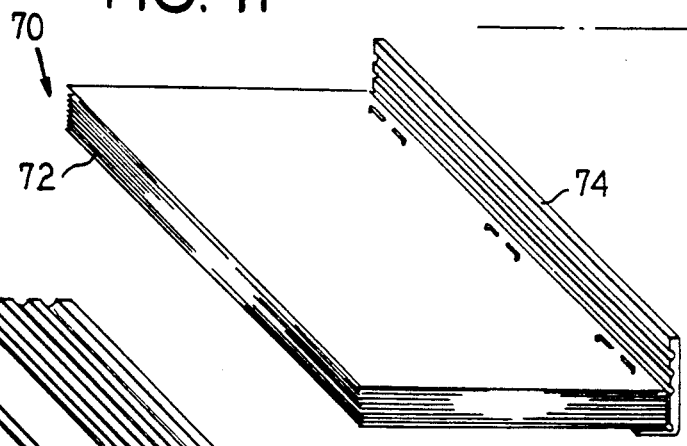
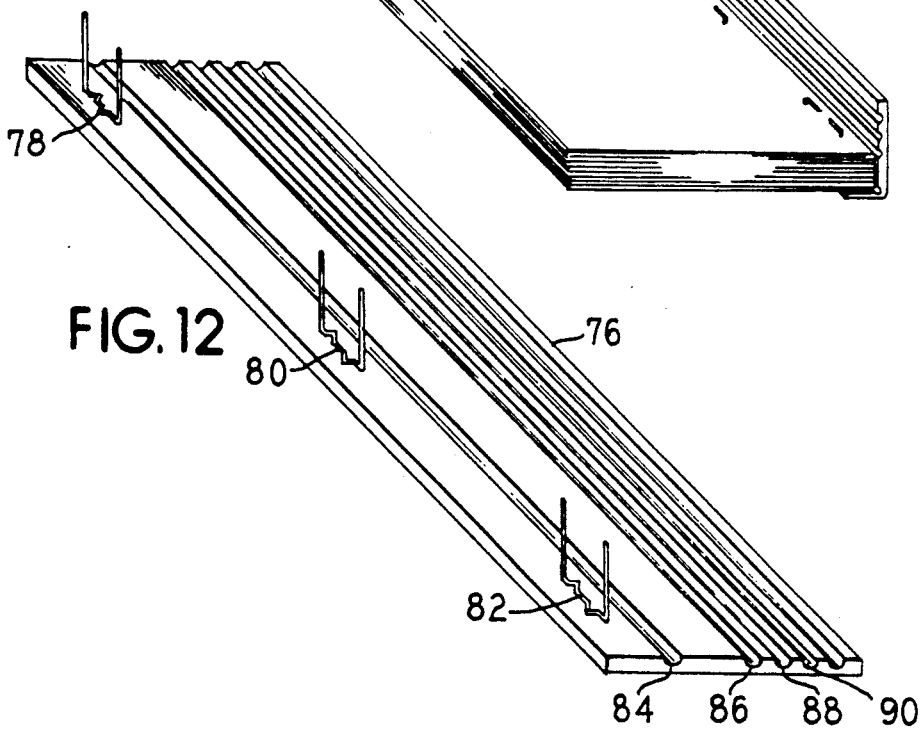
FIG. 12

STAPLE BASED BINDING SYSTEM

BACKGROUND OF THE INVENTION

The invention relates to systems for binding together a plurality or stack of sheets along an edge, and in particular, a strip-type edge-binding systems.

In strip-type edge-binding systems a plurality of stacked sheets are to be bound along an edge using a pair of strips positioned along the side edge on opposite sides of the stack for securement to each other with the sheets bound therebetween.

One form of strip-type edge-binding is commonly referred to as the Velo-Bind® systems in which one strip is plastic, elongated and has a plurality of upstanding integral plastic posts and the other strip is also plastic and has a plurality of openings aligned to receive the posts. The stacked paper includes holes along its edge to receive the posts. To form or bind a booklet the sheets or pages are fitted onto the posts so that the post ends extend from the end of the sheets. The apertured strip is fitted onto the post ends and pressed against the booklet to tightly hold the sheets between the strips. Then the posts may be cut to length and are staked or swagged over, usually with heat, so as to tightly grasp the apertured strip and minimize separation of the strips and enhance securement of the booklet pages therebetween. U.S. Pat. No. 4,708,860 includes a disclosure representative of these systems. Various types of machinery can be required for use in such binding.

An object of this invention is to minimize the equipment needed to provide a satisfactory strip-type edge-binding.

In other systems such as disclosed in U.S. Pat. Nos. 4,119,332 and 4,181,327, there is provided a backing for a book made up of plurality of signatures (i.e., groups of folded pages) having embedded therein an anvil-like member for engagement by a staple-like member to hold book pages along their fold to the backing which is in the cover. This system is not disclosed as usable in a strip-type edge-binding system for binding booklets along a side edge.

Therefore, it is another object of this invention to provide a strip-type edge-binding system which is suitable for binding a plurality of sheets along a side edge thereof.

These and other objects of this invention will become apparent from the following disclosure and appended claims.

SUMMARY OF THE INVENTION

There is provided by this invention a strip-type edge binding system for binding stacks of sheets along an edge, usually a side edge.

In one embodiment this system includes a pair of polymeric elongated edge binding strips, each of which includes upstanding staple-like members extending from the strip adjacent the center and ends thereof. Staple deforming depressions are positioned adjacent each staple-like member. In use a pair of edge-binding strips are positioned opposite each other and are used to bind a series of stacked sheets. In such a case the strips are arranged to face each other with staples from one strip aligned with depressions in the other strip and vice versa.

Other embodiments of the same or similar systems are suggested, such as strips with covers attached.

Moreover, a decorative cover can be used to cover the strips and decorate the strips and booklet.

BRIEF DESCRIPTION OF THE DRAWINGS

FIG. 6 is a perspective view showing a cover for the edge-binding;

FIG. 7 is a perspective view showing the strip cover being applied to the edge-binding;

FIG. 8 is a perspective view showing the cover element being applied to the edge-binding;

FIG. 9 is a perspective view of a booklet cover system which includes the edge-binding system of this invention;

FIG. 10 is a perspective view of that cover;

FIG. 11 is a perspective view of a modified form of the edge-binding system; and FIG. 12 is an enlarged view of the binding system alone.

DESCRIPTION OF THE PREFERRED EMBODIMENT

Figure 1:
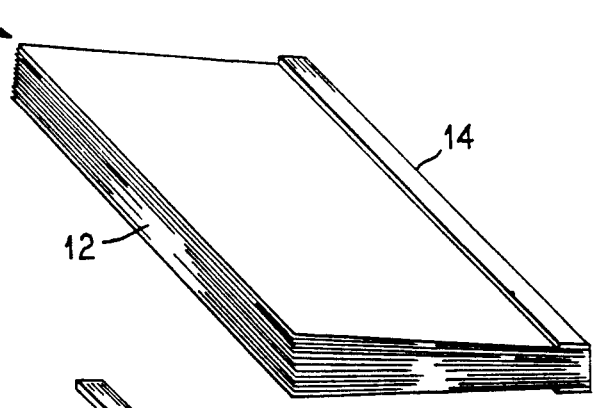
FIG. 1 is a perspective view of an assembled edge bound strip-type binding for a booklet made up of a stack of sheets.
Figure 3:
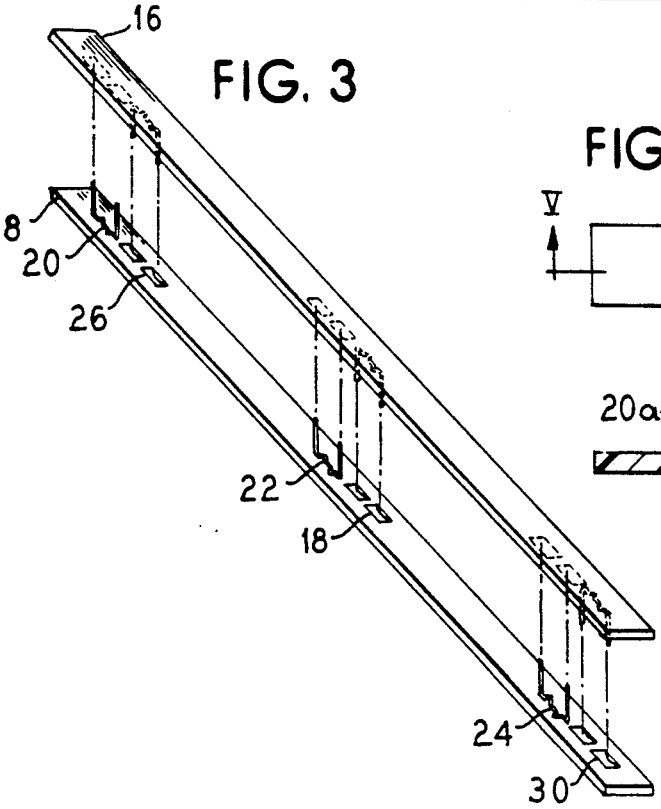
FIG. 3 is a perspective view showing the strip-type edge-binding elements themselves.
Figure 4:
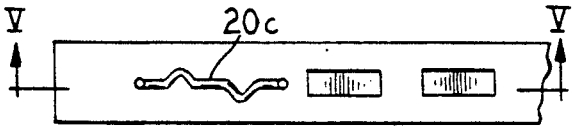
FIG. 4 is an enlarged plan view showing the end of one edge-type strip binding with the anvil and staple therein.

Referring now to FIG. 1, there is shown a booklet 10 which includes a stack or sheaf of sheets, usually paper, to be bound 12, and strip-type edge-binding system 14 along the right-hand edge of the stack. The system 14 includes an upper strip 16 and a lower strip 18. The strips 16 and 18 are identical, except for position. The strip 18 is identical to the strip 16, except that it is inverted and has been rotated 180° about a vertical axis. Each of the strips, such as 18, include three upstanding staples, such as 20, 22 and 24, shown in FIG. 3, located adjacent the center and ends of the strip. Located adjacent each of the staples is a pair of staple-deforming depressions such as 26, 28 and 30.

Figure 5:
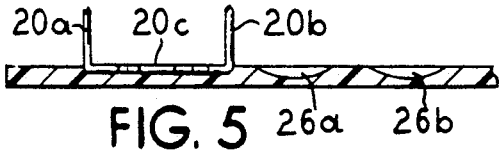
FIG. 5 is a cross-sectional view taken along line V—V of FIG. 4

The staples, such as 20, include upstanding legs, such as **20*a* and 20*b*, and a bight or center portion 20*c* that is embedded in the strip 18. The section 20*c* has an irregular or undulating shape so as to permit some stability in the vertical position. Each of the depressions 26*a* and 26*b* is defined by a shallow curved surface as shown in FIG. 5**.

In order to effectively produce this system the strip is fabricated from plastic such as polycarbonate reinforced with glass fiber, which permits it to deform a staple end which engages the depression.

The staple is embedded in the plastic by insert molding techniques known in the art. In this system the staples are placed in the mold where the strip is to be formed and the bight portion of the staple is molded into the strip.

Figure 2:
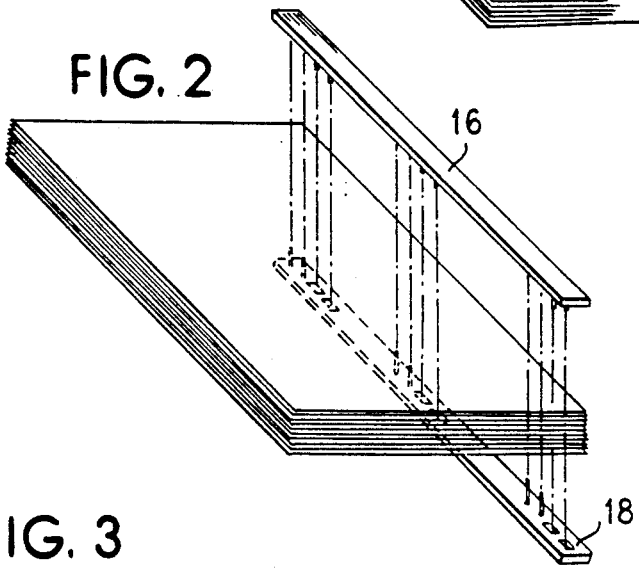
FIG. 2 is an exploded view of the booklet of FIG. 1 showing the staples and staple-forming depressions.

Operation of this device is seen in FIG. 2 where the staple strip is pushed into the sheet and downwardly or upwardly into engagement with the other staple strip which is pushed in the opposite direction. By appropriate arrangement and orientation, the strip 16 is arranged such that its staples engage the depression from the strip 18 and similarly the staples in strip 18 engage the depressions in strip 16.

For decorative purposes the system can be bound with a sleeve-like cover as shown in FIGS. 6–8. In FIG. 6 the booklet 40 is fabricated from the stack of materials 42 and the binding includes the strip-shaped binding elements, such as 44 and 45, and cover element, such as 46. It is noted in FIG. 8 that each of the binding elements, such as 44, include an undercut edge, such as 44*a*, that permits grasping by a cover member and a decoration, such as the decoration 44*b*. The cover element is an elongated channel-like member, such as 46, which include decoration opening apertures 46*a*, and top, bottom and side (or back) surfaces 46*b*, 46*c* and 46*d*. In this embodiment the cover member 46 is constructed to slide onto the edge binders 44 and 45 so as to provide a decoration therefor.

A similar system is shown in FIG. 9 wherein the booklet 50 includes the stacked sheets 52 having a combination edge-binding and cover system 54 thereon. The cover members 54 are shown in FIG. 10 and include in combination a transparent cover, such as 56, and the edge-binding systems such as 58. In this system the edge-binding strip 58 is a stepped construction for folding, but includes the depressions, such as 60, and staple system, such as 62.

In a similar system a one-piece edge-binding system is shown in FIG. 11 wherein the booklet 70 includes the stacked sheets 72 and a binding element 74. The binding element includes an elongated and wide polymeric member 76 having upstanding staple-like members 78, 80 and 82 along one edge thereof. The remainder of the polymeric member can be bent upwardly along a bend line 84 to form the back of the binding member and then forwardly along the other side 86 to engage staples that have been extended through the stack of materials and to bend down those staples. It is seen that the member 76 includes a plurality of grooves, such as 88 and 90, for engaging the staples and bending them.

Although the invention has been described with respect to preferred embodiments, it is not to be so limited as changes and modifications can be made which are within the full intended scope of the invention as defined by the appended claims.

I claim as my invention:

1. A strip-type binding system for securing together a plurality of stacked sheets along an edge and in a booklet form using a pair of strips between which a plurality of sheets are bound, wherein at least one strip is an elongated member having a plurality of fastener receiving and deforming depressions in a surface thereof and a plurality of upstanding staple-like fastener members supportingly embedded therein.

2. A strip-type binding system as in claim 1, wherein said strip has an inside surface for engaging a sheet and an outside surface and wherein said depressions are on the inside surface and are spaced from each other.

3. A strip-type binding system as in claim 2, wherein said strip includes a pair of depressions adjacent each end of the strip and in a center portion.

4. A strip-type binding system as in claim 1, wherein said strip includes at least one U-shaped staple-like fastener which includes a bight portion and a pair of legs wherein said bight portion is embedded and secured in the strip and legs are upstanding with respect to the strip.

5. A strip-type binding system as in claim 4, wherein said bight portion is irregularly shaped for enhancing embedded securement.

6. A strip-type binding system as in claim 4, wherein said strip includes a staple-like fastener adjacent each of said depressions.

7. A strip-type binding system as in claim 4, wherein there is provided a pair of identical strips for insertion along a side edge of a booklet toward each other in which each strip includes at least three sets of depressions with one set at each end and the center of the strip and a staple-like fastener adjacent each depression and on the same side thereof, whereby the legs of the staple-like fastener on one strip engage the depressions on the other strip and vice versa.

8. A strip-type binding system as in claim 7, wherein there are provided a pair of strips for engagement with the opposite sides of a booklet along an edge thereof, one strip including three staple-like fasteners embedded therein for alignment with depressions so that upon positioning and insertion into a booklet the style-like fasteners engage said depressions so as to bind the booklet.

9. A strip-type fastener as in claim 1 and further including cover means wherein each strip is part of a cover.

10. A strip-type fastener as in claim 1, wherein said strip is part of a binder member adapted to surround the back edges of the booklet and overlie the top thereof.

* * * * *